US006567045B2

(12) United States Patent
Suguro et al.

(10) Patent No.: US 6,567,045 B2
(45) **Date of Patent: *May 20, 2003**

(54) WIDE-ANGLE CIRCULAR POLARIZATION ANTENNA

(75) Inventors: Akihiro Suguro, Kanagawa (JP); Hideto Ookita, Kanagawa (JP); Takahito Morishima, Shiga (JP)

(73) Assignee: Kyocera Corporation, Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/242,440

(22) PCT Filed: Jun. 16, 1998

(86) PCT No.: PCT/JP98/02642

§ 371 (c)(1),
(2), (4) Date: Feb. 17, 1999

(87) PCT Pub. No.: WO98/58423

PCT Pub. Date: Dec. 23, 1998

(65) Prior Publication Data

US 2002/0008663 A1 Jan. 24, 2002

(30) Foreign Application Priority Data

Jun. 18, 1997 (JP) ..... 9-161286
May 18, 1998 (JP) ..... 10-135083

(51) Int. Cl.[7] ..... H01Q 1/38; H01Q 21/29

(52) U.S. Cl. ..... 343/700 MS

(58) Field of Search ..... 343/700 MS, 725; H01Q 1/24

(56) References Cited

U.S. PATENT DOCUMENTS

| | | | | | |
|---|---|---|---|---|---|
| 4,958,162 | A | * | 9/1990 | Roberts et al. | 343/700 MS |
| 5,233,360 | A | * | 8/1993 | Kuroda et al. | 343/700 MS |
| 5,248,988 | A | * | 9/1993 | Makino | 343/790 |
| 5,552,798 | A | * | 9/1996 | Dietrich et al. | 343/700 MS |
| 5,650,788 | A | * | 7/1997 | Jha | 343/700 MS |

FOREIGN PATENT DOCUMENTS

| | | |
|---|---|---|
| EP | 0 821 428 A2 | 1/1996 |
| JP | 6-140823 | 5/1994 |
| JP | 7-183719 | 7/1995 |
| JP | 9-98018 | 4/1997 |

* cited by examiner

*Primary Examiner*—Michael C. Wimer
(74) *Attorney, Agent, or Firm*—Schulte Roth & Zabel LLP

(57) ABSTRACT

An antenna adapted for satellite communication. A plurality of planer radiating elements are disposed under a ground conductor of a microstrip planar antenna, and the ground conductor is coupled with the respective radiating elements through electrically coupling means. Further, a plurality of linear radiating elements are coupled with the ground conductor and electrically connected to a sperrtopf applied to a coaxial line which acts as a feeder line. As an antenna used for satellite communication, it is possible to improve the gain at a low elevation angle in a wide angle circular polarization antenna.

12 Claims, 10 Drawing Sheets

Z

REF 1.0 UNIT*
Δ 200.0 mUNIT*/
3 60.811 Ω 64.848 Ω

MARKER 3
1.619 GHz
POINT 431

SWR

REF 1.0
3 1.0 /
∇ 3.0989

*MAREKER 3
1.619 GHz
3.0989

CENTER 1.600000000 GHz
SPAN 0.500000000 GHz

VERTICAL POLARIZATION COMPONENT

HORIZONTAL POLARIZATION COMPONENT

VERTICAL POLARIZATION COMPONENT

HORIZONTAL POLARIZATION COMPONENT

WIDE-ANGLE CIRCULAR POLARIZATION ANTENNA

FIELD OF THE INVENTION

The present invention relates to a communication field, and particularly relates to miniaturization and configuration of a wide angle circular polarization antenna adapted for portable radio communication using a satellite.

BACKGROUND OF THE INVENTION

Recently, plans of a portable telephone using a satellite have been proposed by some companies. A band of 1.6 GHz is allocated to communication (transmission) from a ground portable telephone to a satellite, and a band of 2.4 GHz is allocated to communication from the satellite to the ground portable telephone. The band of 1.6 GHz is also allocated as a frequency band used for bidirectional communication from the ground to the satellite and from the satellite to the ground.

An antenna adapted for such satellite communication, an omnidirectional antenna, is proposed in (JP-A-7-183719). FIG. 12 shows the structure of this omnidirectional antenna disclosed in the JP-A-7-183719.

In FIG. 12, a microstrip planar antenna (MSA) 1 is constituted by a feeding pin 1*a*, a patch-like radiating element 1*b*, and a dielectric substrate 1*c*. The MSA 1 is characterized such that a ground conductor plate 1*d* is extended downward to form a conductor cylinder 1*e* as a ground.

Usually, the MSA 1 has a configuration such that the patch-like radiating element 1*b* is arranged on the ground conductor plate 1*d* in parallel therewith through the dielectric substrate 1*c*. However, the omnidirectional antenna shown in FIG. 12 is characterized in such a way that the whole circumference of the ground conductor plate 1*d* is extended downward to form a cylindrical shape.

By this characteristic, in the omnidirectional antenna shown in FIG. 12, the ground conductor plate 1*d* of the microstrip planar antenna (MSA) 1 is extended downward to improve the gain at a low elevation angle.

In this omnidirectional antenna, however, it is difficult to obtain sensitivity of a horizontally polarized component of a circular polarization at a low elevation angle. Accordingly, in practical use, it is difficult to keep sensitivity of communication since trees or the like absorb a vertically polarized component.

SUMMARY OF THE INVENTION

The present invention discloses a plurality of planar radiating elements that are disposed under a ground conductor plate of a microstrip planar antenna and electrically coupled with the ground conductor plate.

Further, a plurality of planar radiating elements and a plurality of linear radiating elements are disposed under a ground conductor plate of a microstrip planar antenna and electrically coupled with the ground conductor plate. Further, a sperrtopf (blocking bushing) is provided. The "sperrtopf" is a blocking bushing having a configuration in which a cylindrical conductor of ¼ wavelength or ½ wavelength is provided to cover a coaxial line in a vicinity just under the feeding point of the antenna in order to prevent a leakage current from flowing in the outer surface of the outer conductor of the coaxial cable, the cylindrical conductor being opened on the antenna side while it is connected at the other side to the outer conductor of the coaxial line.

DETAILED DESCRIPTION

Figure 1:
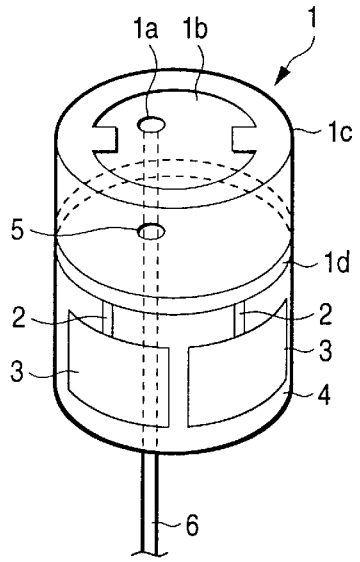
FIG. 1 illustrates a perspective view of a wide angle circular polarization antenna.
Figure 12:
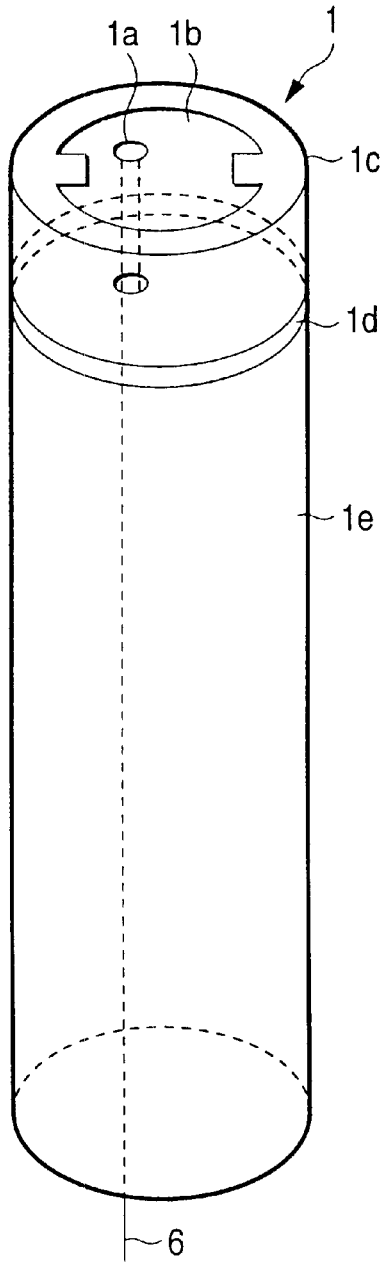
FIG. 12 illustrates a prior art microstrip planar antenna.

Referring to FIG. 1, a schematic diagram illustrating a wide angle circular polarization antenna is shown. In FIG. 1, portions equivalent to those in FIG. 12 are referenced correspondingly. That is, the reference numeral 1 represents a microstrip planar antenna (MSA); 1*a*, a feeding pin of the MSA; 1*b*, a patch-like radiating element of the MSA; 1*c*, a dielectric substrate of the MSA; 1*d*, a ground conductor plate of the MSA; 2, an electrically connecting means; 3, a planar radiating element; 4, a dielectric cylinder (support cylinder); 5, a feeding point; and 6, a feeder line (coaxial line, or coaxial cable).

The MSA 1 which can be in the form of a circle, a quadrilateral, or the like, acts as a circular polarization antenna with a desired frequency. The circular polarization antenna with such a desired frequency is achieved when suitable design is given to the parameters of the dielectric substrate 1*c*, the size of the patch-like radiating element 1*b* pasted on the dielectric substrate 1*c*, and the position of the feeding pin 1*a*. Examples of the parameters are relative dielectric constant, and dimensions. The MSA is of a circularly polarized mode having a conductor, and patch-like radiating element disposed on the conductor plate through a dielectric layer so as to be in parallel with the conductor plate.

However, the impedance matching based on the resonance frequency and the position of the feeding pin 1*a* should be done carefully because it depends on the shape and arrangement of the planar radiating element, and the method used for electrical connection. When impedance matching is based on the position of the feeding pin 1*a*, it is necessary to make an offset from the center of the dielectric substrate 1*c* in order to meet the characteristic impedance of the feeder line 6 (usually 50Ω). This offset causes turbulence in a high-frequency current, so that the radiating pattern is distorted.

FIG. 1 shows an embodiment of the present invention, in which the operating frequency of the microstrip planar antenna 1 is about 1.6 GHz. The circular patch-like radiating element 1*b* is pasted on the circular dielectric substrate 1*c*. The ground conductor plate 1*d* of the microstrip planar antenna 1 is supported by the dielectric cylinder 4 having substantially the same diameter as the ground conductor plate 1*d*. Four planar radiating elements 3 curved in accordance with the curved shape of the circumference of the dielectric cylinder 4 are pasted on the whole circumference of the latter equidistantly or at regular intervals.

The planar radiating elements 3 are not always necessary to be curved but they may be arranged without being curved. Preferably, the number of the planar radiating elements 3 is selected to be four or more.

Further, it is preferable to select the thickness of the dielectric substrate 1*c* substantially equal to the longitudinal dimension of the planar radiating elements 3. In order to obtain a radiation pattern omnidirectionally, it is important that the surface where the planar radiating elements 3 are distributed and disposed is the circumference having substantially the same diameter as the microstrip planar antenna 1. FIG. 1 illustrates the ground conductor plate 1*d* electrically coupled with the planar radiating elements 3 through wires 2. IT is understood that use of wires is not the only way to electrically couple the planar radiating elements 3 and the ground conductor plate 1*d*. The ground conductor plate 1*d* is a ground conductor common to the microstrip planar antenna 1 and the planar radiating elements 3.

In an embodiment of the invention the dielectric substrate 1*c* has a relative dielectric constant of about 20, a diameter of about 30 mm, and a thickness of about 10 mm. The dielectric cylinder 4 has a relative dielectric constant of about 4, a diameter of about 30 mm, and a height of about 20 mm. The thickness of the dielectric substrate 1*c* and the longitudinal dimension of the planar radiating elements 3 are made substantially equal to each other. It is understood that other dielectric constants and dimensions are suitable for embodiments of the invention.

In the antenna according to this embodiment, the sensitivity of a horizontal polarization component in the microstrip planar antenna 1 at a low elevation angle is improved by the action of a high-frequency current flowing in the transverse direction of the planar radiating elements 3, while the sensitivity of a vertical polarization component is improved by the action of a high-frequency current flowing in the longitudinal direction of the elements 3.

In comparison with the above antenna, in the configuration according to the conventional technique shown in FIG. 12, it is difficult for a high-frequency current to flow horizontally so that the axial ratio is large at a low elevation angle, though the sensitivity of a vertical polarization component is improved.

In the embodiment shown in FIG. 1, the four planar radiating elements 3 are made rectangular and disposed on one and the same circumference of the side surface of the dielectric cylinder 4. However, the present invention is not limited to such an embodiment. Various planer radiating elements shown in FIGS. 2A to 2D, FIGS. 3A to 3K, or the like, may be combined desirably in accordance with the form of a satellite orbit, a satellite altitude or the like of a desired satellite communication system.

Figure 2:
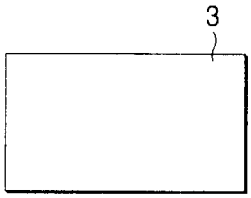
FIGS. 2A to 2D illustrate basic and typical shapes of a planar radiating element.
Figure 2:
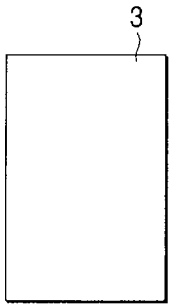
Figure 2:
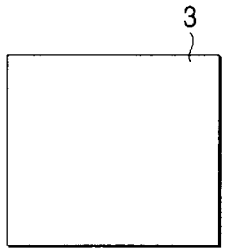
Figure 2:
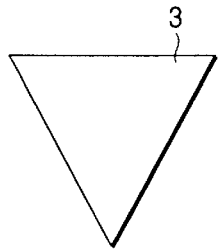

FIGS. 2A to 2D show examples of the typical basic shape of the planar radiating element. The examples of the basic shape include a rectangle which is long from side to side as shown in FIG. 2A, a rectangle which is longer than it is wide as shown in FIG. 2B, a square as shown in FIG. 2C, and a triangle as shown in FIG. 2D.

Figure 3:
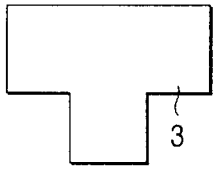
FIGS. 3A to 3K illustrate typical modified shapes of a planar radiating element.
Figure 3:
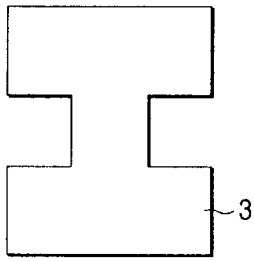
Figure 3:
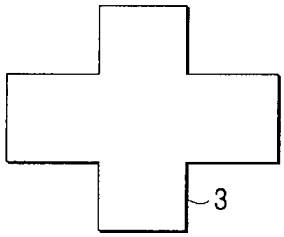
Figure 3:
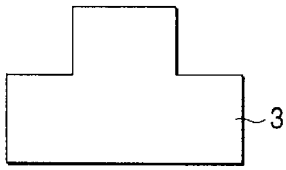
Figure 3:
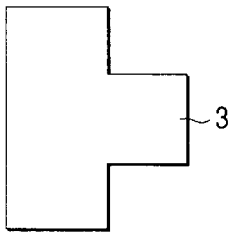
Figure 3:
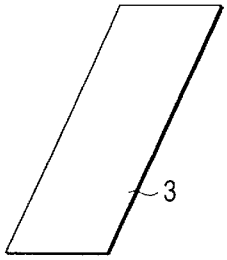
Figure 3:
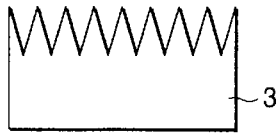
Figure 3:
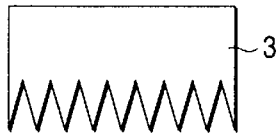
Figure 3:
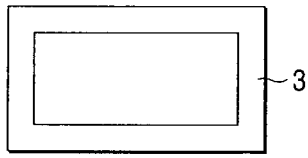
Figure 3:
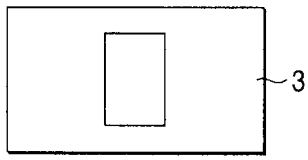
Figure 3:
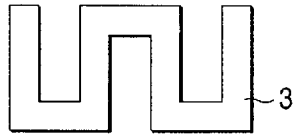

FIGS. 3A to 3K show examples of the typical modified shape of the planar radiating element. The examples include uneven shapes as shown in FIGS. 3A to 3E, an inclined shape as shown in FIG. 3F, notched shapes as shown in FIGS. 3G and 3H, hollow shapes (frame-like shapes) as shown in FIGS. 3I and 3J, and a radial shape as shown in FIG. 3K. It is understood that the various examples are shown as examples of other embodiments of the invention. The invention is not limited to the shapes disclosed.

Further, according to the present invention, various configurations of electrical coupling are shown in FIGS. 4A to 4C, FIGS. 5A to 5C, and FIGS. 6A to 6E. It is understood that the electrical coupling is not limited to the examples shown in the above mentioned figures. Any of the electrical coupling elements illustrated in FIGS. 4A to 4C, FIGS. 5A to 5C, and FIGS. 6A to 6C may be desirably combined with various planar radiating elements as shown in FIGS. 2A to 2D and FIGS. 3A to 3K.

Figure 4:
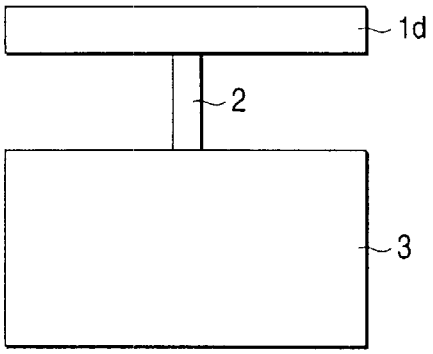
FIGS. 4A to 4C illustrate a ground conductor plate and the planar radiating element which are electrically coupled with each other.

FIGS. 4A to 4C show examples of the electrical coupling between the planar radiating element 3 and the ground conductor plate 1*d*. Shown are various configurations of the coupled positions between the conductor plate 1*d* and the planar radiating element 3. The coupled positions are not limited to those shown in FIGS. 4A to 4C.

Figure 5:
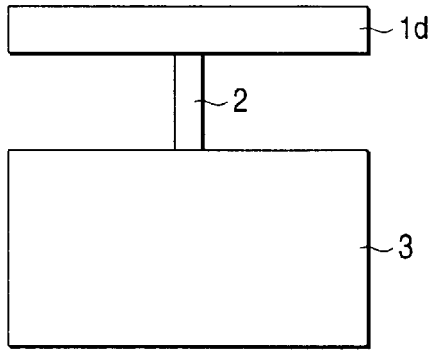
FIG. 5A illustrates DC coupling between a ground conductor plate and a planar radiating element by a wire.
FIG. 5B illustrates capacitive coupling between a ground conductor plate and a planar radiating element by a capacitive element.
FIG. 5C illustrates inductive coupling between a ground conductor plate and a planar radiating element by an inductive element.
Figure 4:
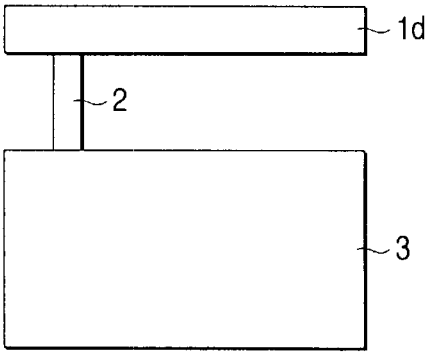
Figure 5:
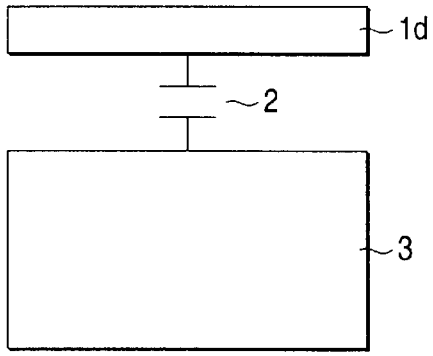
Figure 4:
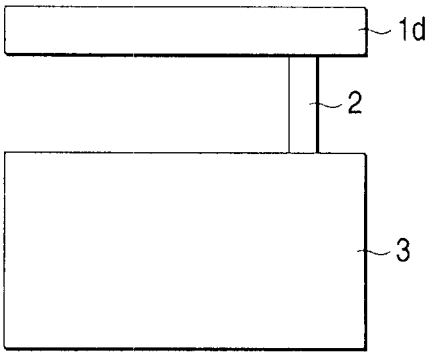
Figure 5:
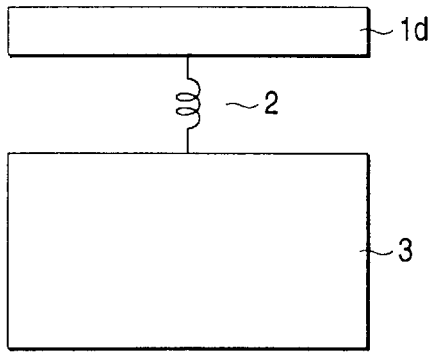

FIGS. 5A to 5C are diagrams each showing other ways of electrically coupling the conductor plate 1*d* and the planar radiating element 3 through electrical coupling 2. FIG. 5A shows a DC coupling in which the conductor plate 1*d* and the planar radiating element 3 are coupled through the electrical coupling 2 constituted by a wire. FIG. 5B shows electrical coupling 2 constituted by a capacitive element, producing capacitive coupling. FIG. 5C shows electrical coupling 2 constituted by an inductive element, producing inductive coupling.

Figure 6:
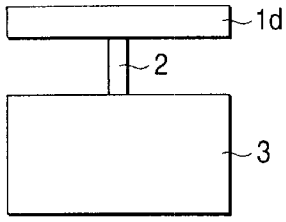
FIGS. 6A to 6E illustrate the length and width of the electrically coupling between a ground conductor plate and a planar radiating element.
Figure 6:
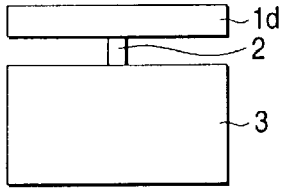
Figure 6:
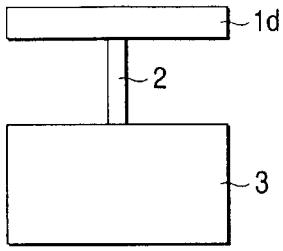
Figure 6:
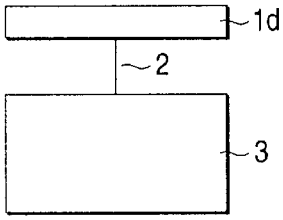
Figure 6:
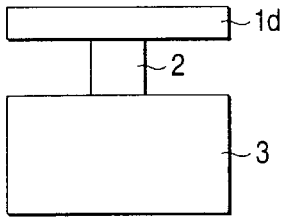

FIGS. 6A to 6E show examples of the configuration of the electrical coupling 2 different in width and length from each other. FIGS. 6A to 6C show examples of the electrical coupling 2 different in length from each other, while FIGS. 6D and 6E show examples of the electrical coupling means 2 different in width from each other.

The various examples of the planar radiating element mentioned above, and the various examples of the electrical coupling mentioned above and shown in FIGS. 2A to 2D, FIGS. 3A to 3K, FIGS. 4A to 4C, FIGS. 5A to 5C and FIGS. 6A to 6E may be selectively desirably combined as setting elements for obtaining a desired antenna radiation pattern. Because there are many combinations as described above, the degree of freedom in design for obtaining a desired antenna radiation pattern is very large.

Figure 7:
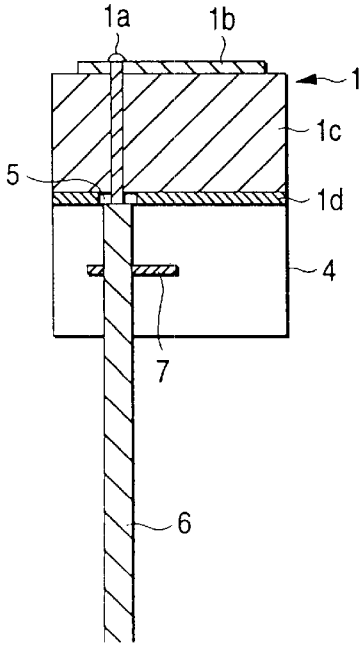
FIG. 7A illustrates a side sectional view of a wide angle circular polarization antenna which corrects the distortion of a radiating pattern.
FIG. 7B illustrates a bottom view of FIG. 7A.
FIG. 7C illustrates a side sectional view of the wide angle circular polarization antenna which corrects the distortion of a radiating pattern.
Figure 7:
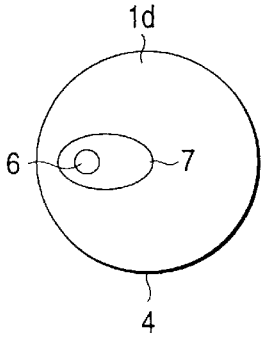
Figure 7:
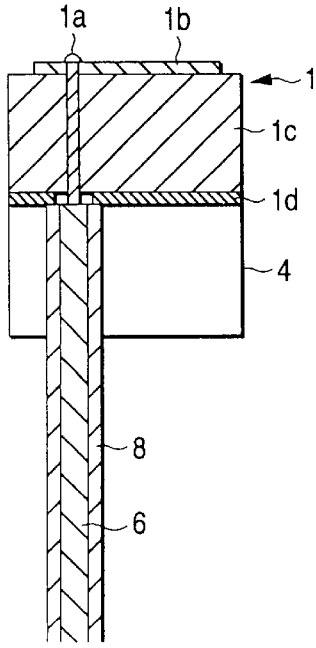

In addition, FIGS. 7A and 7B show an example in which an apparatus for correcting distortion of the radiation pattern caused by the interaction with a feeder line.

FIG. 7A is a side sectional view of a wide angle circular polarization antenna, and FIG. 7B is a view of the wide angle circular polarization antenna viewed from the bottom to show the inside of the dielectric cylinder 4. An ellipsoidal conductor 7 (see FIG. 7B) is used for correction, and a feeder line 6 is passed through the conductor 7. The planar radiating elements 3 and the electrical coupling 2 pasted on the curved surface of the dielectric cylinder 4 are not shown in FIGS. 7A and 7B.

FIG. 7C is a sectional view showing another example for correcting distortion of the radiation pattern. In this configuration, the feeder line 6 is surrounded by a dielectric body 8. In this way the apparatus for correcting the distortion is provided within the vicinity of a feeder line.

In combination with a portable radio equipment, when a wide angle circular polarization antenna is installed removably from a portable radio equipment housing, the example of the configuration shown in FIG. 7C may be used for fixedly supporting the wide angle circular polarization antenna on the portable radio equipment housing at a predetermined distance from the housing.

Figure 8:
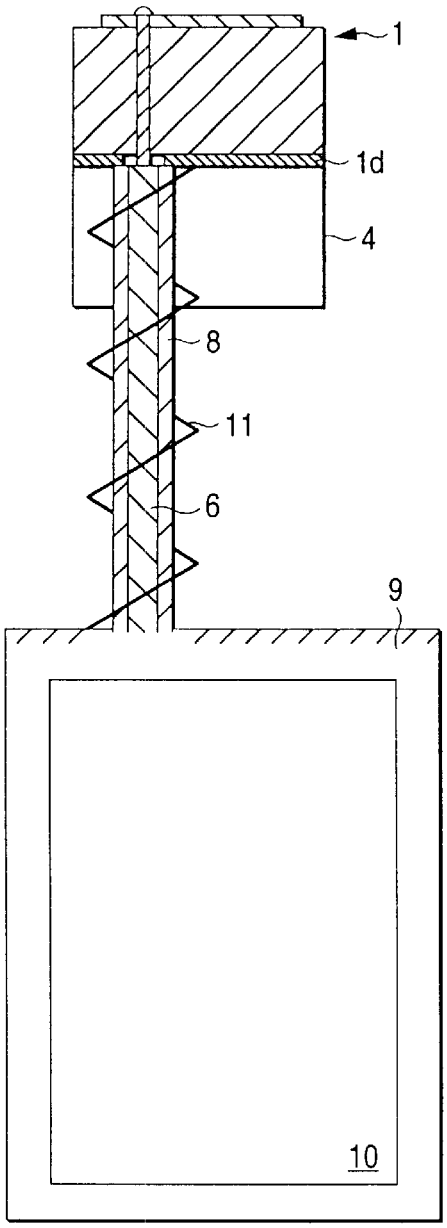
FIG. 8A illustrates a wide angle circular polarization antenna which is kept away from a portable radio equipment housing.
FIG. 8B illustrates a wide angle circular polarization antenna which is kept close to a portable radio equipment housing.
Figure 8:
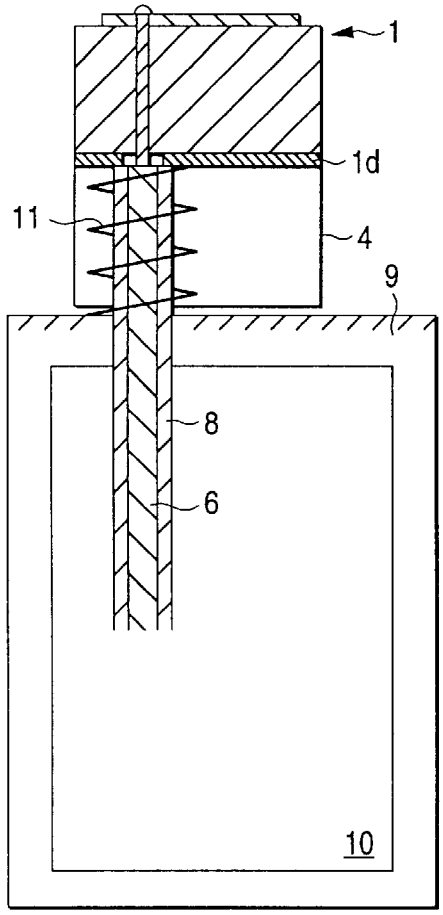
Figure 9:
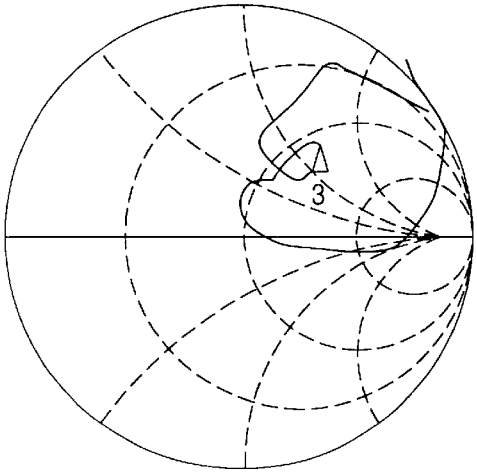
FIG. 9A illustrates a Smith chart showing double resonance.
FIG. 9B illustrates an example of VSWR.
Figure 9:
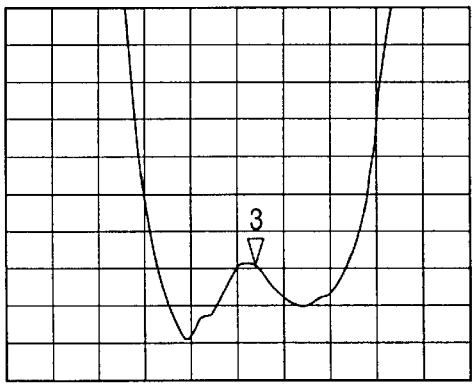

FIGS. 8A and 8B show a configuration in which a wide angle circular polarization antenna can be made close to or away from the housing of a portable radio equipment. FIGS. 8A and 8B are schematic sectional views showing a main part in section of the wide angle circular polarization antenna is attached to a portable radio equipment. FIG. 8A is a wide angle circular polarization antenna which is kept away from the portable equipment housing and in which the feeder line is drawn out of the housing. FIG. 8B is a wide angle circular polarization antenna which is kept close to the portable radio equipment and in which the feeder line is drawn into the housing.

As shown in each of FIGS. 8A and 8B, a dielectric body 8 provided with a built-in feeder line is arranged so that it can be pushed into and drawn out of the housing 9 of a portable radio equipment desirably.

In FIGS. 8A and 8B, the reference numeral 10 represents a portable radio equipment circuit. A wide angle circular polarization antenna configured similarly to that shown in FIG. 7C according to the present invention is provided at the top of the dielectric body 8.

In this embodiment shown in FIGS. 8A and 8B, an elastic body 11 is attached to the outer circumference of the dielectric body 8. That is, the dielectric body 8 is disposed, for example, inside a spring which is an elastic body. It is understood that the elastic body 112 is not limited to springs but can be any elastic body.

When the wide angle circular polarization antenna is drawn out of the housing 9 (see FIG. 8A), the elastic force of the spring 11 (the force for pushing and opening the wide angle circular polarization antenna and the housing) acts so that the dielectric body 8 fixedly supports the wide angle circular polarization antenna in a predetermined position away from the housing 9.

On the other hand, when the dielectric body 8 is pushed into the housing 9 (see FIG. 8B), the wide angle circular polarization antenna is fixed in the vicinity of the portable radio equipment housing 9 by a suitable lock (not shown) against the repulsive force of the spring 11.

Figure 10:
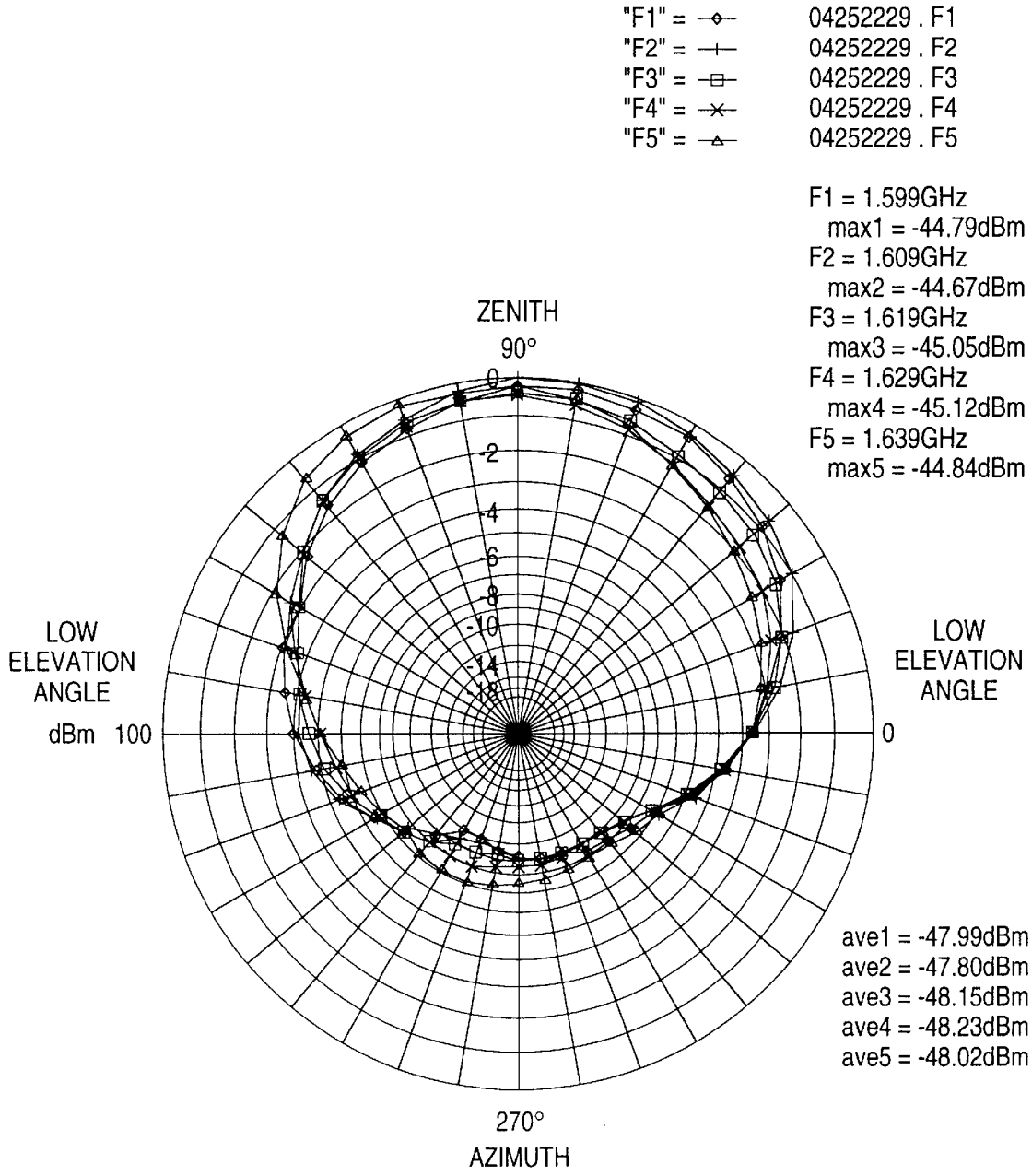
FIG. 10 illustrates a radiation pattern in the wide angle circular polarization antenna.
Figure 11:
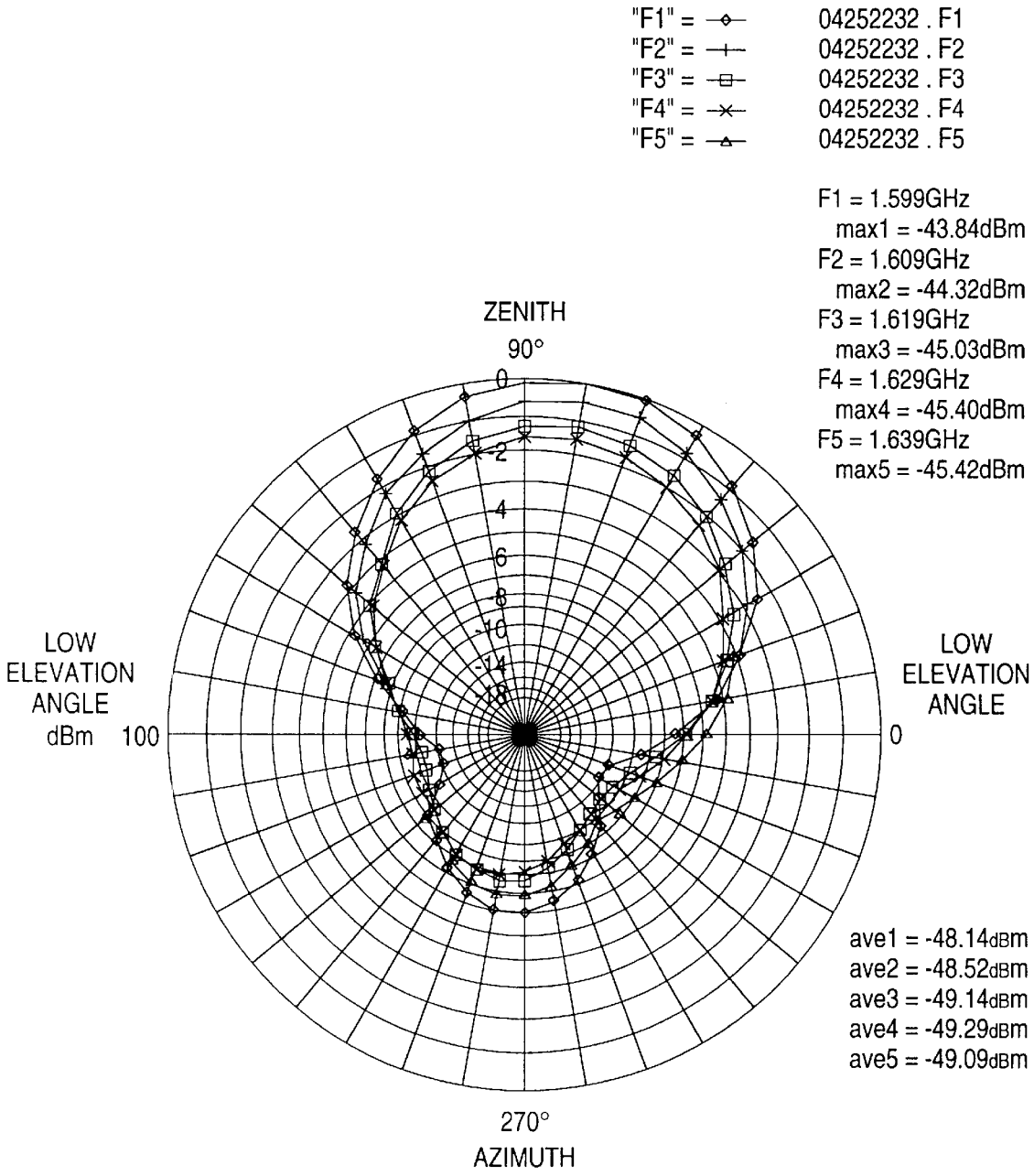
FIG. 11 illustrates a radiation pattern in the wide angle circular polarization antenna.

FIGS. 9A, 9B, 10 and 11 show examples of measurement of Smith chart, VSWR, and radiation pattern, of the wide angle circular polarization antenna in the embodiment of the present invention. In FIG. 10, the radiation pattern in the wide angle circular polarization antenna is measured in the positional relationship in which the horizontal polarization is provided at a low elevation angle. In FIG. 11, the radiation pattern in the wide angle circular polarization antenna is measured in the positional relationship in which the vertical polarization is provided at a low elevation angle.

Figure 13:
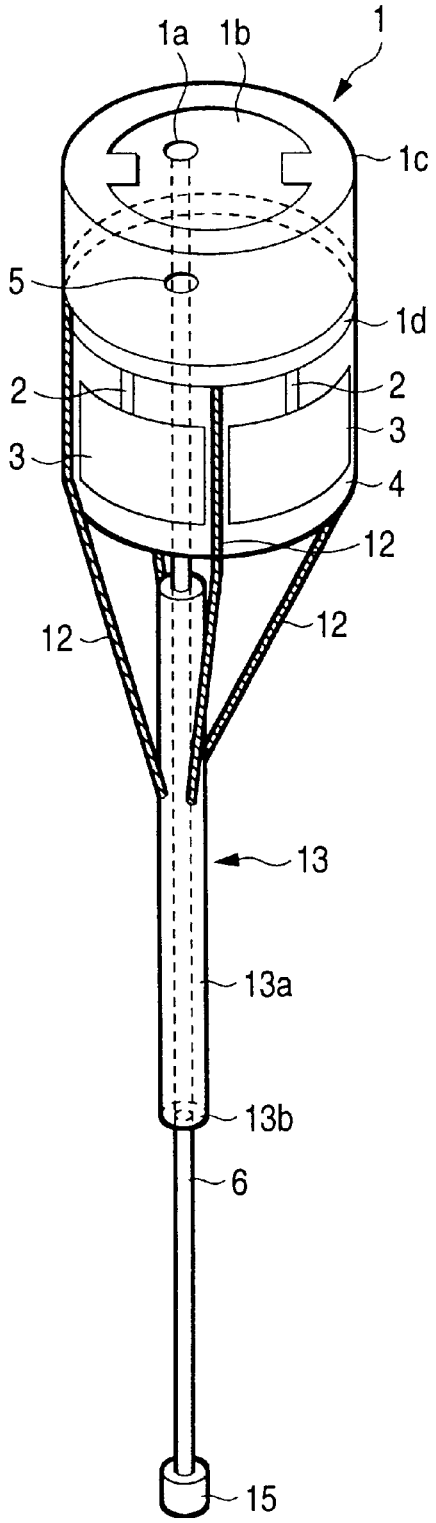
FIG. 13 illustrates a perspective view of a wide angle circular polarization antenna.

FIG. 13 shows another embodiment of the wide angle circular polarization antenna according to the present invention. In FIG. 13, parts equivalent to those in FIG. 1 are referenced correspondingly, and the description about those parts is omitted here.

Of the constituent parts of the antenna in this embodiment shown in FIG. 13, linear radiating elements 12 and a sperrtopf 13 are not provided in the antenna shown in FIG. 1.

The sperrtopf 13 is constituted by a conductor cylinder 13*a* put on a coaxial line 6. The coaxial line 6 and the conductor cylinder 13*a* are opened on the microstrip planar antenna side, while an outer conductor of the coaxial line 6 is connected to the conductor cylinder 13*a* so as to be short-circuited in an end portion 13*b* on the side opposite to the microstrip planar antenna. The electrical length of the sperrtopf 13 is selected to be about ¼ wavelength or about ½ wavelength.

The four linear radiating elements 12 are made to have an electrical length of about ¼ wavelength, and disposed on the side surface of the dielectric cylinder 4 alternately with four planar radiating elements 3. One end of each linear radiating element 12 is electrically coupled with a ground conductor plate 1*d*, while the other end of the elements 12 is electrically connected to the surface of the conductor cylinder 13*a*. The ends of the radiation elements 12 are electrically coupled with the sperrtopf 13.

In such a manner in this embodiment of FIG. 13, there is provided a composite radiation element structure in which the liner radiating elements 12 are provided in addition to the planar radiating elements 3.

In the embodiment of FIG. 13, a dielectric substrate 1*c* has a relative dielectric constant of about 29, a diameter of 28 mm, and a thickness of 10 mm. A dielectric cylinder 4 is formed of ceramics (forsterite) having a relative dielectric constant of about 6.5, a diameter of 28 mm, a height of 20 mm, and a thickness of 2 mm. A wire of 0.6 mm diameter is used for the linear radiating elements 12. The conductor cylinder 13*a* of the sperrtopf 13 has an outer diameter of 6 mm diameter. It is understood that the invention is not limited to the dielectric constants and materials, and dimensions in the above mentioned embodiment.

A semi-rigid cable having an outer diameter of about 2.2 mm diameter is used as the coaxial line 6. A central conductor of the coaxial line 6 is connected at its one end to a feeding pin 1*a*, and connected at its other end to a connector 15. Each of the planar radiating elements 3 is 10 mm long and 15 mm wide. Each of the electrical coupling 2 is 5 mm long and 2 mm wide. The sperrtopf 13 is disposed under the planar radiating elements 3 so as not to overlap the planar radiating elements 3. The invention is not limited to the dimensions in the above mentioned embodiment.

In the wide angle circular polarization antenna of FIG. 13, the sensitivity of a horizontal polarization component in the microstrip planar antenna 1 at a low. elevation angle is improved by the action of a high-frequency current flowing in the transverse direction of the planar radiating elements 3, while the sensitivity of a vertical polarization component in the microstrip planar antenna 1 at a low elevation angle is improved by the action of a high-frequency current flowing in the longitudinal direction of the planar radiating elements 3 and a high-frequency current flowing along the linear radiating elements 12.

As has been described above, in this embodiment of the present invention, four rectangular planar radiating elements are disposed on one and the same side circumferential surface of the dielectric cylinder 4. However, the present invention is not limited to this, and various shapes of the planer radiating elements 3 may be combined desirably in accordance with the forms of a satellite orbit, a satellite altitude, or the like, of a desired satellite communication system. Further, as for the linear radiating elements 12 and the sperrtopf 13, it is possible to control the axial ratio or the gain by adjusting the respective lengths of the linear radiating elements and the sperrtopf or coupled positions thereof.

Figure 14:
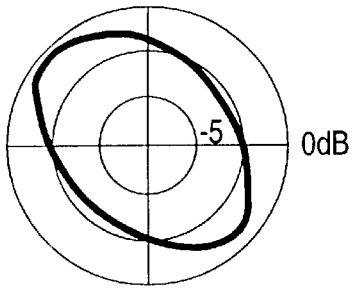
FIG. 14A and FIG. 14B illustrate radiation characteristic diagrams.
Figure 14:
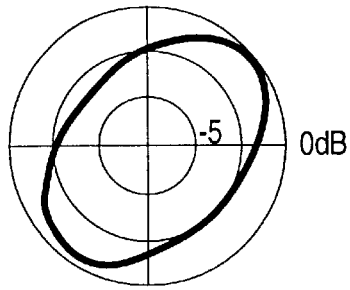

FIGS. 14A and 14B are radiation characteristic diagrams at a low elevation angle of the antenna in FIG. 13, FIG. 14A showing a vertical polarization component, FIG. 14B showing a horizontal polarization component.

Figure 15:
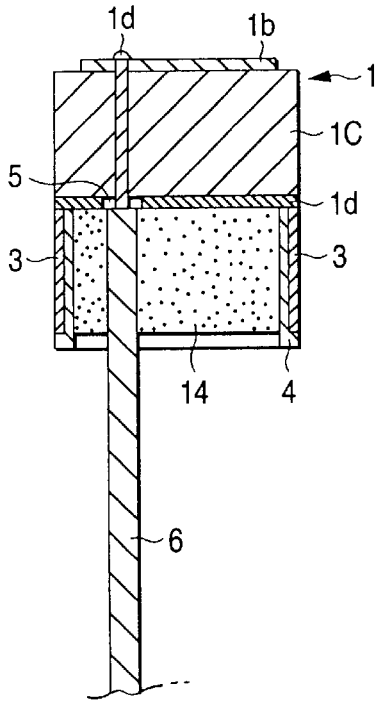
FIG. 15 illustrates a wide angle circular polarization antenna.

FIG. 15 is a sectional view of a wide angle circular polarization antenna showing a further embodiment of the present invention. Also in FIG. 15, parts equivalent to those in the other drawings are referenced correspondingly.

In this embodiment shown in FIG. 15, a radio wave absorber 14 is charged, as an apparatus for correcting distortion of the radiation pattern, in the inside of the dielectric cylinder 4 in the antenna shown in FIG. 1. The apparatus for correcting the distortion of the radiation pattern can also be, but is not limited to a conductor, and a dielectric body. The apparatus for correcting the distortion of the radiation pattern is provided under the conductor plate so as to be surrounded by the plurality of radiation elements.

Inside the four planar radiating elements 3, the radio wave absorber 14 relieves interference between the feeder line 6 and the planar radiating elements 3. As a result, the radiation patterns of a horizontal polarization component and a vertical polarization component become substantially uniform.

Figure 16:
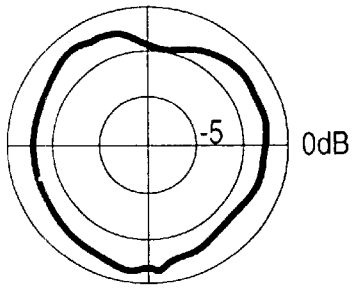
FIGS. 16A and 16B are radiation characteristic diagrams.
Figure 16:
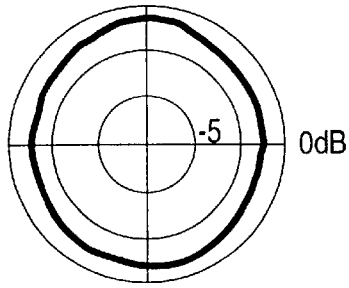

FIGS. 16A and 16B are radiation characteristic diagrams in which the radio wave absorber is charged in the inside of the dielectric cylinder 4 up to the position corresponding to the height of the planar radiating elements 3 in the antenna shown in FIG. 13, FIG. 16A showing the result of measurement of a vertical polarization component, FIG. 16B showing the result of measurement of a horizontal polarization component.

If the characteristics of FIGS. 16A and 16B are compared with those of FIGS. 14A and 14B, it is clear that the embodiment shown in FIGS. 16A and 16B in which a radio wave absorber is charged, is superior in effect to the embodiment shown in FIGS. 14A and 14B in which no radio wave absorber is charged.

As has been described above, according to the present invention, it is possible to provide a wide angle circular polarization antenna in which sensitivity of a horizontal polarization component in circle polarization at a low elevation angle can be obtained, and the sensitivity of communication can be maintained in practical use even if the vertical polarization component is absorbed by trees, or the like.

What is claimed is:

1. A wide angle circular polarization antenna comprising: a microstrip planar antenna of a circularly polarized mode having a conductor plate which acts as a common ground conductor, and only a single patch radiating element disposed above said conductor plate through a dielectric layer so as to be in parallel with said conductor plate; and a plurality of planar radiating elements disposed under said conductor plate;

said conductor plate and said respective planar radiating elements being coupled through electrically coupling means, said electrically coupling means being narrower in width than a width of said planar radiating elements to be coupled.

2. A wide angle circular polarization antenna according to claim 1, wherein said plurality of planar radiating elements are distributed and disposed under said conductor plate and on a face having substantially the same diameter as said microstrip planar antenna.

3. A wide angle circular polarization antenna according to claim 1, wherein a plurality of linear radiating elements are provided under said conductor plate, and said plurality of linear radiating elements are electrically coupled with said conductor plate, distributed and disposed on a face having substantially the same diameter as said microstrip planar antenna so as to alternate with said plurality of planar radiating elements.

4. A wide angle circular polarization antenna according to claim 1, wherein a balun is provided in a feeder line of said microstrip planar antenna.

5. A wide angle circular polarization antenna according to claim 1, wherein said plurality of planar radiating elements are distributed and disposed under said conductor plate and on a face having substantially the same diameter as said microstrip planar antenna, and wherein said antenna further comprises radiation pattern distortion correcting means including at least one of a conductor, a dielectric body, and a radio wave absorber and provided under said conductor plate so as to be surrounded by said plurality of radiation elements.

6. A wide angle circular polarization antenna according to claim 4, wherein said feeder line is a coaxial line having an inner and outer conductor, and wherein said balun comprises a conductor cylinder surrounding said coaxial line and the outer conductor of said coaxial line is connected to said conductor cylinder so as to be short-circuited at its end opposite to said antenna.

7. A wide angle circular polarization antenna according to claim 6 further comprising a plurality of linear radiating elements electrically coupled with said conductor plate and distributed between said planar radiating elements, wherein said linear radiating elements are electrically connected to said conductor cylinder.

8. A wide angle circular polarization antenna comprising: a microstrip planar antenna of a circular polarized mode having a conductor plate which acts as a common ground conductor, and only a single patch radiating element disposed above said conductor plate through a dielectric layer so as to be in parallel with said conductor plate;

a plurality of planar radiating elements and a plurality of linear radiating elements disposed under said conductor plate; and electrically coupling means for coupling said conductor plate with first end of respective said planar radiating elements and respective said linear radiating elements, said electrically coupling means being narrower in width than a width of said planar radiating elements to be coupled;

a balun provided in a feeder line of said microstrip planar antenna.

9. A wide angle circular polarization antenna according to claim 8, wherein said plurality of planar radiating elements and said plurality of linear radiating elements are distributed and disposed under said conductor plate and on a face having substantially the same diameter as said microstrip planar antenna.

10. A wide angle circular polarization antenna according to claim 8, wherein the other ends of said linear radiating elements are electrically coupled with said balun.

11. A wide angle circular polarization antenna according to claim 8, wherein said plurality of planar radiating elements and said plurality of linear radiating elements are distributed and disposed under said conductor plate and on a face having substantially the same diameter as said microstrip planar antenna, and wherein said antenna further comprises radiation pattern distortion correcting means including at least one of a conductor, a dielectric body, and a radio wave absorber and provided under said conductor plate so as to be surrounded by said plurality of radiation elements.

12. A wide angle circular polarization antenna according to claim 8, wherein said feeder line is a coaxial line having an inner and outer conductor, and wherein said balun comprises a conductor cylinder surrounding said coaxial line and the outer conductor of said coaxial line is connected to said conductor cylinder so as to be short-circuited at its end opposite to said antenna.

* * * * *